US010815557B2

(12) United States Patent
Saegusa

(10) Patent No.: US 10,815,557 B2
(45) **Date of Patent: *Oct. 27, 2020**

(54) COPPER ALLOY SHEET MATERIAL AND METHOD FOR PRODUCING COPPER ALLOY SHEET MATERIAL

(71) Applicant: JX NIPPON MINING & METALS CORPORATION, Tokyo (JP)

(72) Inventor: Kei Saegusa, Kanagawa (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 393 days.

This patent is subject to a terminal disclaimer.

(21) Appl. No.: 15/466,912

(22) Filed: Mar. 23, 2017

(65) Prior Publication Data

US 2017/0283924 A1 Oct. 5, 2017

(30) Foreign Application Priority Data

Mar. 31, 2016 (JP) ..... 2016-073349

(51) Int. Cl.
*C22F 1/08* (2006.01)
*C22C 9/00* (2006.01)
*C22C 9/06* (2006.01)

(52) U.S. Cl.
CPC ..... *C22F 1/08* (2013.01); *C22C 9/00* (2013.01); *C22C 9/06* (2013.01)

(58) Field of Classification Search
CPC ..... C22F 1/08; C22C 9/00; C22C 9/06
See application file for complete search history.

(56) References Cited

U.S. PATENT DOCUMENTS

2010/0269959 A1* 10/2010 Gao ..... C22C 9/00 148/554
2017/0283925 A1* 10/2017 Saegusa ..... B22D 11/004

FOREIGN PATENT DOCUMENTS

| | | | |
|---|---|---|---|
| JP | 2006152392 | A | 6/2006 |
| JP | 2010090408 | A | 4/2010 |
| JP | 2010275622 | A | 12/2010 |
| JP | 2011084764 | A | 4/2011 |
| JP | 2012197503 | A | 10/2012 |
| JP | 2015101759 | A | 6/2015 |

* cited by examiner

*Primary Examiner* — John A Hevey
(74) *Attorney, Agent, or Firm* — Faegre Drinker Biddle & Reath LLP

(57) ABSTRACT

A copper alloy sheet material which contains 0.5 to 2.5% by mass of Ni, 0.5 to 2.5% by mass of Co, 0.30 to 1.2% by mass of Si and 0.0 to 0.5% by mass of Cr, the balance being Cu and unavoidable impurities. The material fulfills the relationships $1.0 \leq I\{200\}/I_0\{200\} \leq 5.0$ and $5.0\ \mu m \leq GS \leq 60.0\ \mu m$, and these have the relationship (Equation 1): $5.0 \leq \{(I\{200\}/I_0\{200\})/GS\} \times 100 \leq 21.0$, in which the I {200} represents an X-ray diffraction intensity of a {200} crystal plane, the $I_0$ {200} represents an X-ray diffraction intensity of a {200} crystal plane of standard pure copper powder, and the GS (μm) represents an average crystal grain size. An electrical conductivity is 43.5% to 55.0% IACS and 0.2% yield strength is 720 to 900 MPa.

4 Claims, 3 Drawing Sheets

COPPER ALLOY SHEET MATERIAL AND METHOD FOR PRODUCING COPPER ALLOY SHEET MATERIAL

BACKGROUND OF THE INVENTION

1. Field of the Invention

The present invention relates to an age-hardening type copper alloy sheet material and a method for producing the same. More particularly, it relates to a Cu—Ni—Si based alloy sheet material that is suitable for use in various electronic components such as connectors, lead frames, pins, relays and switches, and to a method for producing the same.

2. Description of Related Art

Copper alloy sheet materials for electronic materials used for various electronic components such as connectors, lead frames, pins, relays and switches are required to establish high strength for withstanding the stress applied during assembly or operation and high conductivity for suppressing the heat generation due to electricity supply. These various electronic components are also required to establish both outstanding press formability and good bending formability, because these components are formed by punching and bending copper alloy sheet materials for electronic materials in a press maker which is generally a direct customer for a copper alloy maker.

Recently, miniaturization and thinning of electronic devices have been rapidly progressed, thereby further increasing the demand levels of the copper alloy sheet material for electronic materials used in various electronic components included in the electronic devices. More particularly, as the demand levels, the copper alloy sheet material has been required to achieve a high strength level of 0.2% yield strength of 720 MPa or more, high conductivity of 43.5% IACS or more, and 180° bendability of R/t=0 in a direction parallel to a rolling direction (GW) and a direction perpendicular to the rolling direction (BW), and has been also required to have further improved press formability.

However, there is generally a trade-off relationship between the strength and conductivity of the copper alloy sheet material, so that a solid solution-strengthened type copper alloy sheet material represented by conventional phosphor bronze, brass, nickel silver and the like cannot satisfy the demand levels. Therefore, recently, age-hardening type copper alloy sheet materials that will be able to satisfy such demand levels have been increasingly used. In the age-hardening type copper alloy sheet material, fine precipitates can be uniformly dispersed and the strength of the alloy can be increased by means of an aging treatment of the supersaturated solid solution subjected to a solutionizing treatment, as well as the conductivity can be improved due to a decrease in amounts of solid solution elements in the Cu matrix (base material).

Among the age-hardening type copper alloy sheet materials, a Cu—Ni—Si based copper alloy (so-called Corson alloy) sheet material is one of the alloys attracting attention in the art as a copper alloy sheet material having good balance between the strength and the conductivity. This copper alloy is known to have the increased strength and conductivity due to the deposition of the fine particles of the Ni—Si based intermetallic compound in the matrix (base material).

However, since the Cu—Ni—Si based copper alloy has the higher strength, the bending formability is not necessarily satisfactory. In general, a copper alloy sheet also has a trade-off relationship between the strength and the bending formability, in addition to the relationship between the strength and the conductivity as described above. Therefore, the Cu—Ni—Si based copper alloy tends to cause a decrease in the bending formability when increasing the strength using a method of increasing the addition amount of the solute elements Ni and Si of such an alloy or a method of increasing the degree of finish rolling after the aging treatment. For this reason, it has been an extremely difficult problem that the copper alloy sheet materials achieving all the high strength, the high conductivity and the good bending formability and further having improved press formability are developed.

The copper alloy sheet materials that can solve this problem may include beryllium copper. However, this alloy may generate dusts having carcinogenicity during the processing, and may have large environmental load. Therefore, recently, there has been a strong need for the development of alternate materials in the electronics device manufactures.

In recent years, a method for improving the bending formability by controlling the crystal orientation has been proposed to solve such problems of the strength and the bending formability in the Cu—Ni—Si based copper alloy sheet material. For example, Patent Document 1 has successfully achieved both the high strength and the improved bending formability by carrying out pre-annealing under appropriate conditions before a solutionizing treatment step, and then performing the solutionizing treatment step to control an area ratio of various crystal orientations such as Cube orientation and Brass orientation.

Further, Patent Document 2 has successfully achieved all the high strength, the high conductivity and the improved bending formability by carrying out intermediate annealing under appropriate conditions before the solutionizing treatment step, and increasing a proportion of a {200} crystal plane (so-called Cube orientation) after the subsequent solutionizing treatment, and further increasing an average twin crystal density within the crystal grain. Furthermore, Patent Document 3 has succeeded in obtaining the improved bending formability while maintaining the high strength, by controlling a ratio of a {200} crystal plane and a {422} crystal plane. Moreover, Patent Document 4 has succeeded in obtaining the improved bending formability while maintaining the high strength and the high conductivity, by controlling the Cube orientation ({200} crystal plane) and the crystal grain size.

CITATION LIST

Patent Documents

[Patent Document 1] Japanese Patent Application Public Disclosure (KOKAI) No. 2012-197503 A1
[Patent Document 2] Japanese Patent Application Public Disclosure (KOKAI) No. 2010-275622 A1
[Patent Document 3] Japanese Patent Application Public Disclosure (KOKAI) No. 2010-90408 A1
[Patent Document 4] Japanese Patent Application Public Disclosure (KOKAI) No. 2006-152392 A1

SUMMARY OF INVENTION

However, the method disclosed in Patent Document 1 focuses on the development of the {200} crystal plane, so that the balance between the {200} crystal plane and the grain size may be lost and the dimensions during the press working may deteriorate. This is a serious problem for press working makers who are customers for copper alloy makers, leading to a problem that most of the materials after the press working must be disposed because the materials do not fall within the dimensional tolerance required by the electronic component manufacturers who are customers for the press working makers. To address the problem, periodic maintenance of the cutting edge of the die may be performed, but this will require stopping the press die and disassembling the die during press processing, so that the productivity will be sharply decreased.

Further, the methods disclosed in Patent Documents 2 and 3 focus on the controlling of the ratio between the {200} crystal plane and the {422} crystal plane, so that the balance between the {200} crystal plane and the grain size is not appropriate, and the dimension during the press working is extremely poor.

Although the method disclosed in Patent Document 4 focuses on the controlling of the Cube orientation and the crystal grain size, it does not consider any press formability, and if this producing method is adopted, the dimension during the press working will be very poor.

In view of the above problems, an object of the present invention is to provide a Cu—Ni—Si based copper alloy sheet material that achieves all high strength, high conductivity and improved bending formability and has improved press formability, and a method for the producing the same.

The present inventors focused on a Cu—Ni—Si based copper alloy sheet material containing Co and Cr based on results of intensive studies to solve the above problems. Subsequently, the present inventors have continued studies on the Cu—Ni—Si based copper alloy sheet material containing Co and Cr, and have found that for achieving the combined properties of the high strength, the high conductivity, improved bending formability and improved press formability, it is important to have very exquisite balance between the {200} crystal plane and the crystal grain size in the copper alloy having a composition comprising 0.5 to 2.5% by mass of Ni, 0.5 to 2.5% by mass of Co, 0.3 to 1.2% by mass of Si and 0.0 to 0.5% by mass of Cr, the balance being Cu and unavoidable impurities, and have completed the present invention.

The present invention has been made based on the above findings. In one aspect, there is provided a copper alloy sheet material having a composition comprising 0.5 to 2.5% by mass of Ni, 0.5 to 2.5% by mass of Co, 0.30 to 1.2% by mass of Si and 0.0 to 0.5% by mass of Cr, the balance being Cu and unavoidable impurities, wherein the copper alloy sheet material fulfills the relationships $1.0 \leq I\{200\}/I_0\{200\} \leq 5.0$ and $5.0\ \mu m \leq GS \leq 60.0\ \mu m$, and these have the relationship (Equation 1): $5.0 \leq \{(I\{200\}/I_0\{200\})/GS\} \times 100 \leq 21.0$, in which the I {200} represents an X-ray diffraction intensity of a {200} crystal plane on the plate surface, the $I_0$ {200} represents an X-ray diffraction intensity of a {200} crystal plane of standard pure copper powder, and the GS (μm) represents an average crystal grain size as determined by a cutting method of JIS H 0501, and wherein the copper alloy sheet material has conductivity of 43.5% IACS or more and 55.0% IACS or less, and 0.2% yield strength of 720 MPa or more and 900 MPa or less.

In one embodiment, the copper alloy sheet material according to the present invention further contains, in total, up to 0.5% by mass of one or more selected from the group consisting of Mg, Sn, Ti, Fe, Zn and μg.

In another aspect of the present invention, there is provided a method for producing a copper alloy sheet material, comprising the successive steps of: melting and casting a raw material of a copper alloy having a composition comprising 0.5 to 2.5% by mass of Ni, 0.5 to 2.5% by mass of Co, 0.30 to 1.2% by mass of Si, and 0.0 to 0.5% by mass of Cr, the balance being Cu and unavoidable impurities; hot-rolling the material while lowering the temperature from 950° C. to 400° C.; cold-rolling the material at a rolling rate of 30% or more; pre-annealing the material by carrying out a heat treatment for the purpose of deposition, at a heating temperature of 350 to 500° C. for 5.0 to 9.5 hours (calculation formula (Equation 2): $t=38.0 \times \exp(-0.004\ K)$ is satisfied between the time of the pre-annealing step (t) and a temperature K (° C.)); cold-rolling the material at a rolling rate of 70% or more; solutionizing the material at a heating temperature of 700 to 980° C.; aging-treating the material at 350 to 600° C.; and finish-cold-rolling the material at a rolling rate of 10% or more and 40% or less, wherein the producing conditions are adjusted such that calculation formula (Equation 3): $K=4.5 \times (I\{200\}/I_0\{200\} \times \exp(0.049a)+76.3)$ is satisfied among a degree of processing a in the finish cold rolling step, $I\{200\}/I_0\{200\}$ after the finish cold rolling step, and a temperature K (° C.) in the pre-annealing step.

In another embodiment of the method for producing the copper alloy sheet material according to the present invention, the copper alloy sheet material further contains, in total, up to 0.5% by mass of one or more selected from the group consisting of Mg, Sn, Ti, Fe, Zn and Ag.

According to the present invention, it is possible to provide a Cu—Ni—Si based copper alloy sheet material that can achieve all high strength, high conductivity and improved bending formability and can have improved press formability, and to provide a method for producing the same.

DESCRIPTION OF EMBODIMENTS

Figure 1:
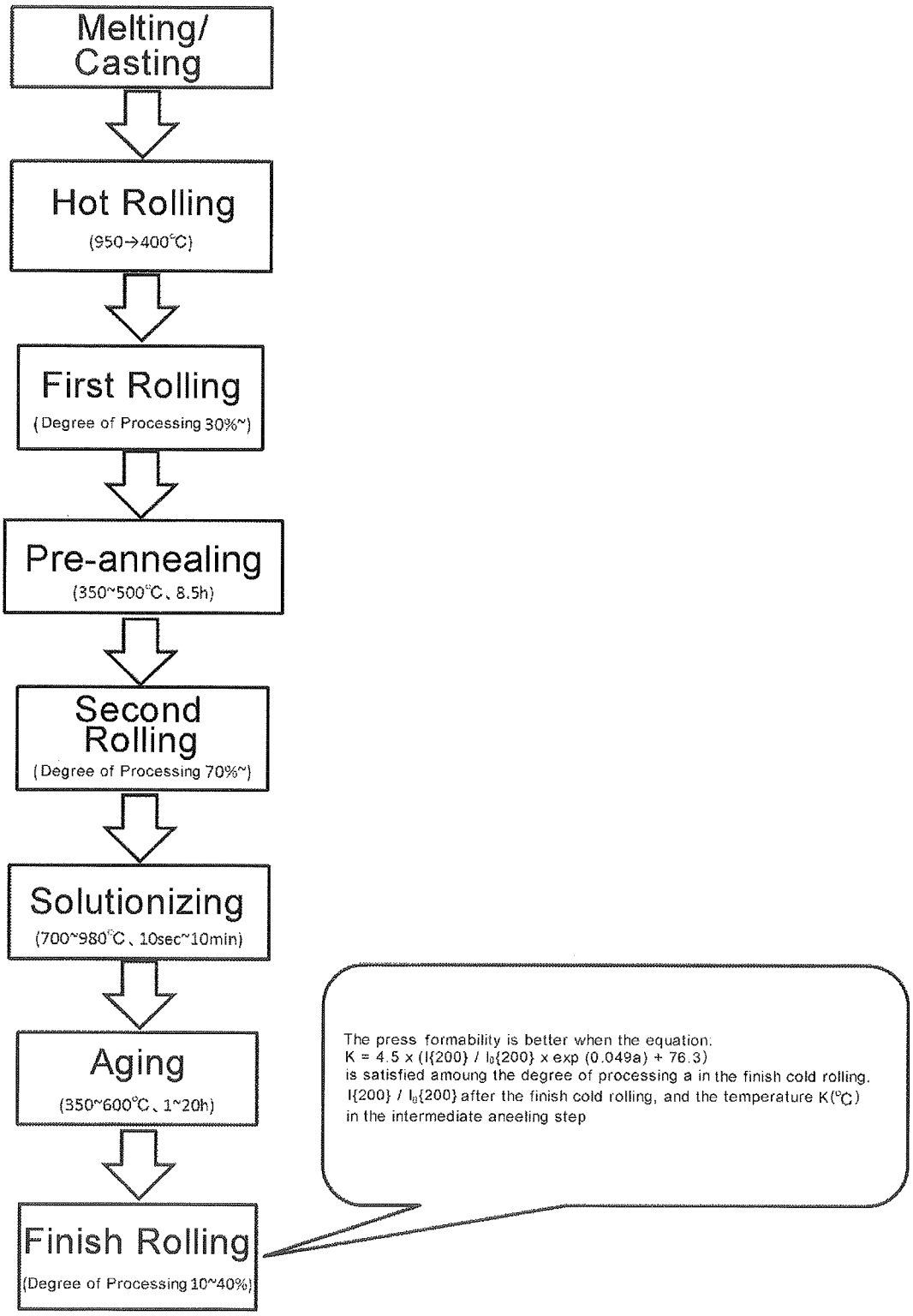
FIG. 1 is a flowchart of producing steps according to an embodiment of the present invention.
Figure 2:
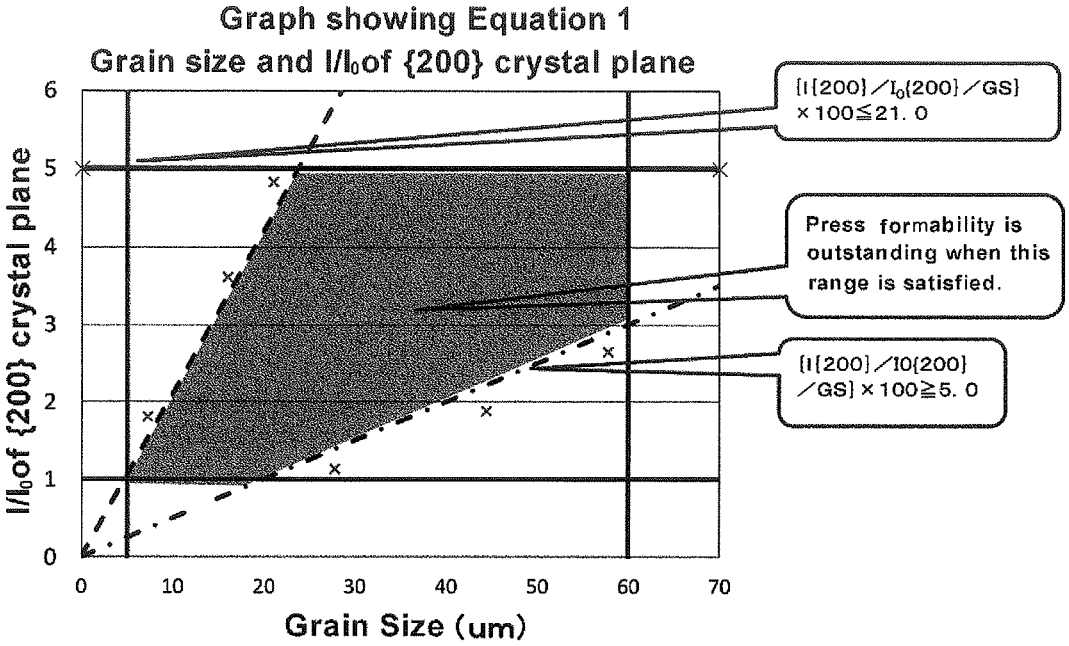
FIG. 2 is a graph showing an equation for material properties according to an embodiment of the present invention.
Figure 3:
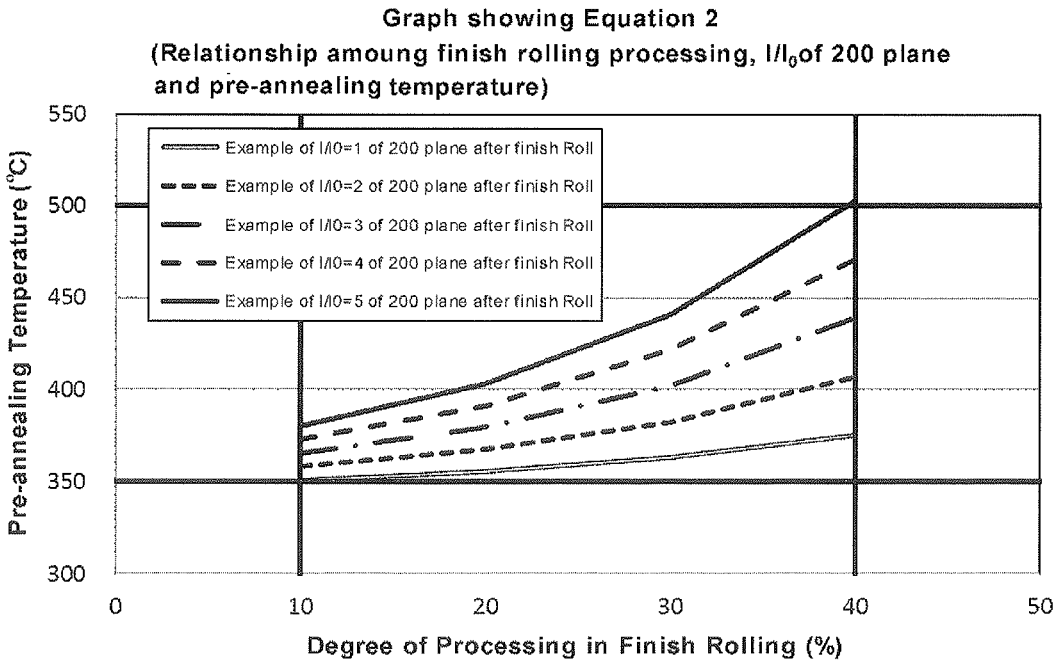
FIG. 3 is a graph showing an equation for producing steps according to an embodiment of the present invention.

Hereinafter, a copper alloy sheet material according to an embodiment of the present invention will be described. The copper alloy sheet material according to the present invention relates a copper alloy sheet material having a composition comprising 0.5% to 2.5% by mass of Ni, 0.5% to 2.5% by mass of Co, 0.3% to 1.2% by mass of Si, 0.0% to 0.5% by mass of Cr, the balance being Cu and unavoidable impurities, wherein the copper alloy sheet material has a crystal orientation that satisfies the equation: $1.0 \leq I\{200\}/I_0\{200\} \leq 5.0$ in which the I {200} represents an X-ray diffraction intensity of a {200} crystal plane on the plate surface; the $I_0$ {200} represents an X-ray diffraction intensity of a {200} crystal plane of pure copper standard powder.

Further, the copper alloy sheet material has an average crystal grain size GS of 5.0 μm to 60.0 μm, preferably 10 μm to 40 μm, as determined by distinguishing the crystal grain boundary from the twin boundary on the surface of the copper alloy sheet material, and using a cutting method of JIS H 0501 without including the twin boundary, and has the relationship: $5.0 \leq \{(I\{200\}/I_0\{200\})/GS\} \times 100 \leq 21.0$ for the crystal orientation and the average crystal grain size. The conductivity of such a copper alloy sheet material is 43.5% IACS or more and 55.0% IACS or less, and in further embodiments 44.5% IACS to 52.5% IACS, and more particularly 46.0 IACS to 50.0% IACS. The 0.2% yield strength is 720 MPa or more and 900 MPa or less, and in further embodiments 760 to 875 MPa, and more preferably 800 to 850 MPa. Hereinafter, the copper alloy sheet material and the method for producing the same will be described in detail.

(Alloy Composition)

An embodiment of the copper alloy sheet material according to the present invention comprises a Cu—Ni—Co—Si—Cr based copper alloy sheet material containing Cu, Ni, Co, and Si, and further containing impurities unavoidable for casting. Ni, Co and Si form Ni—Co—Si based intermetallic compounds by performing an appropriate heat treatment, and can achieve the high strength without deteriorating the conductivity.

Ni and Co requires amounts of about 0.5% to about 2.5% by mass of Ni and about 0.5% to about 2.5% by mass of Co for the high strength and the high conductivity targeted by the present invention, and preferably about 1.0% to about 2.0% by mass of Ni and about 1.0% to about 2.0% by mass of Co, and more preferably about 1.2% to about 1.8% by mass of Ni and about 1.2% by mass to about 1.8% by mass of Co. However, if the amounts of Ni and Co are less than about 0.5%, respectively, any desired strength will not be obtained, and conversely, if the amounts of Ni and Co are more than about 2.5% by mass, the high strength can be achieved but the conductivity will be remarkably lowered, and further hot rolling formability will be decreased, which cases are not preferred. Si requires an amount of about 0.30% to about 1.2% by mass, for satisfying the targeted strength and conductivity, and preferably about 0.5% to about 0.8% by mass. However, if the amount of Si is less than about 0.3% by mass, any desired strength will not be obtained, and if it is more than about 1.2% by mass, the high strength can be achieved but the conductivity will be remarkably lowered and further the hot rolling formability will be decreased, which cases are not preferred.

(Mass Ratio of (Ni+Co)/Si)

The Ni—Co—Si based deposits formed by Ni, Co and Si are considered to be intermetallic compounds based on (Co+Ni) Si. However, all Ni, Co and Si in the alloy are not always deposited by the aging treatment, and some of them are present in a solid solution state in the Cu matrix. Ni and Si in the solid solution state slightly improve the strength of the copper alloy sheet material, but its effect is smaller as compared with the deposition state, and also may be a factor of decreasing the conductivity. Therefore, it is preferable that the ratio of the contents of Ni, Co and Si is as close as possible to the composition ratio of the deposit (Ni+Co) Si. Accordingly, the mass ratio [Ni+Co]/Si is preferably adjusted to 3.5 to 6.0, and more preferably to 4.2 to 4.7.

(Amount of Cr Added)

In the present invention, Cr is preferably added in an amount of about 0.0% to about 0.5% by mass, and preferably about 0.09% to about 0.5% by mass, and more preferably about 0.1% to about 0.3% by mass, to the Cu—Ni—Si based copper alloy containing Co as stated above. Cr can be deposited as Cr alone or a compound with Si in the Cu matrix by an appropriate heat treatment, thereby increasing the conductivity without impairing the strength. However, if the amount of Cr is more than about 0.5% by mass, it will cause undesirable coarse inclusions which will not contribute to strengthening, so that the formability and the plating properties will be impaired.

(Other Additive Elements)

The addition of certain amounts of Mg, Sn, Ti, Fe, Zn and Ag is effective in improving the manufacturability including improvement of plating properties and improvement of hot rolling formability due to refinement of the ingot structure. Therefore, one or more of these elements can be optionally added to the Cu—Ni—Si based copper alloy containing Co as stated above depending on the required properties. In such a case, the total amount of these elements may be at most about 0.5% by mass, and preferably about 0.01% to 0.1% by mass. If the total amount of these elements exceeds about 0.5% by mass, the decrease in the conductivity and the deterioration of the manufacturability will be remarkable, which will not be preferred.

One of ordinary skill in the art will be able to understand that the individual amounts of the elements added may vary depending on the combination of the elements to be added. In one embodiment, the individual contents include, but not limited to, for example 0.5% or less of Mg, 0.5% or less of Sn, 0.5% or less of Ti, 0.5% or less of Fe, 0.5% or less of Zn, and 0.5% or less of Ag. It should be noted that the copper alloy sheet materials of the present invention are not limited to those having these upper limits, as long as they have a combination of the additive elements or added amounts of the elements such that the finally obtained copper alloy sheet materials maintain the 0.2% yield strength of 720 MPa or more and 900 MPa or less, and exhibits the conductivity of 43.5% IACS or more and 55.0% IACS or less.

The method for producing the copper alloy sheet material comprises the successive steps of:

melting and casting a raw material of the copper alloy having the composition as stated above;

hot-rolling the material while lowering the temperature from 950° C. to 400° C.;

cold-rolling the material at a rolling rate of 30% or more (hereinafter, this step is referred to as "first rolling" step);

pre-annealing the material by carrying out a heat treatment for the purpose of deposition, at a heating temperature of 350 to 500° C. for 5.0 to 9.5 hours;

cold-rolling the material at a rolling rate of 70% or more (hereinafter, this step is referred to as "second rolling" step);

solutionizing the material at a heating temperature of 700 to 980° C. for 10 seconds to 10 minutes;

aging-treating the material at 350 to 600° C. for 1 to 20 hours; and finally finish-cold-rolling the material at a rolling rate of 10% or more and 40% or less (hereinafter, this step is also referred to as "finish rolling step"), wherein the producing conditions are adjusted such that calculation formula (Equation 3): $K=4.5\times(I\{200\}/I_0\{200\}\times \exp(0.049a)+76.3)$ is satisfied among a degree of processing a in the finish rolling step, $I\{200\}/I_0\{200\}$ after the finish rolling step and a temperature K (° C.) in the pre-annealing step, and calculation formula (Equation 2): $t=38.0\times\exp(-0.004K)$ is satisfied between the time of the pre-annealing step (t) and the temperature K (° C.).

After the finish rolling step, a heat treatment (low temperature annealing) can be optionally performed at 150° C. to 550° C. This can lead to a reduction of the residual stress inside the copper alloy sheet material with little decrease in the strength, thereby improving the spring limit value and the stress relaxation resistance.

After the hot rolling, surface cutting may be carried out as needed, and after the heat treatment, pickling, polishing and degreasing may be carried out as needed. These can be easily carried out by one of ordinary skill in the art. Hereinafter, these steps will be described in detail.

(Melting and Casting Step)

A slab is produced by melting a raw material of the copper alloy and then casting it by continuous casting or semi-continuous casting according to the same manner as the general melting and casting method of the copper alloy sheet material. For example, raw materials such as electrolytic copper, Ni, Si, Co and Cr may be first melted using an atmospheric melting furnace to obtain a molten metal having the desired composition, and the molten metal may be then casted into an ingot. In one embodiment of the production method according to the present invention, one or more selected from the group consisting of Mg, Sn, Ti, Fe, Zn and Ag can be contained in the total amount of up to about 0.5% by mass.

(Hot Rolling Step)

The hot rolling is carried out in the same manner as the general copper alloy producing method. The hot rolling of the slab is performed in several passes while lowering the temperature from 950° C. to 400° C. It should be noted that the hot rolling is performed in one or more passes at a temperature lower than 600° C. The total rolling rate may be preferably approximately 80% or more. After the hot rolling, it is preferable to perform rapid cooling by water cooling or the like. After the hot processing, surface cutting or pickling may be conducted as necessary.

(First Rolling Step)

The first rolling step can be carried out in the same manner as the general rolling method of the copper alloy, and the rolling rate of 30% or more is sufficient. However, if the rolling rate is too high, the degree of processing in the second rolling step must be inevitably reduced. Therefore, the rolling rate should be preferably from 50 to 80%.

(Pre-Annealing Step)

Then, pre-annealing is carried out for the purpose of developing Cube orientation in the subsequent solutionizing step. In the conventional method, the pre-annealing is carried out at 400° C. to 650° C. for about 1 to 20 hours for the purpose of depositing Ni, Co, Si, Cr and the like. However, such producing conditions are insufficient to achieve all the high strength, the high conductivity, the improved bending formability and the improved press property, targeted by the present invention.

The present inventors have studied the compatibility of those various properties and found that all the high strength, the high conductivity, the improved bending formability and improved press formability can be achieved, only in the case of proper balance between the crystal grain size (GS) and the {200} crystal plane on the plate surface in the final product (after the finish rolling step). More particularly, the present inventors found that the balance of the 0.2% yield strength, the conductivity, the bending formability and the press formability have been excellent when the relationships: $1.0 \leq I\{200\}/I_0\{200\} \leq 5.0$ and $5.0\ \mu m \leq GS \leq 60.0\ \mu m$, and $5.0 \geq \{(I\{200\}/I_0\{200\})/GS\} \times 100 \leq 21.0$ (Equation 1) have been satisfied, in which relationships, the I {200} represents an X-ray diffraction intensity of the {200} crystal plane on the plate surface, the $I_0$ {200} represents an X-ray diffraction intensity of the {200} crystal plane of the pure copper standard powder, and the GS (μm) represents an average crystal grain size as determined by the cutting method of JIS H 0501.

In order to produce the final product satisfying the Equation 1, producing steps must be designed, which control the crystal grain size and the {200} crystal plane after the finish rolling step. One of ordinary skill in the art will be able to easily achieve the control of the crystal grain size after the finish rolling step by controlling the temperature and time of the solutionizing treatment. It is generally known that for the method of controlling the {200} crystal plane after the finish rolling step, the larger amounts of deposits after the pre-annealing step cause stronger development of the {200} crystal plane in the subsequent solutionizing step, and the higher degree of processing leads to development of a rolling texture having the {220} crystal plane as a principal orientation component and hence a decrease in the {200} crystal plane. Therefore, in order to control the {200} crystal plane in the final product, the conditions of the pre-annealing step and the finish rolling step must be optimized.

Regarding the producing conditions in the pre-annealing step and the finish rolling step, the inventors have evaluated the {200} crystal plane in the final product under various producing conditions, and found that the Equation 1 can be satisfied when producing the product such that the relationship: $K=4.5\times(I\{200\}/I_0\{200\}\times\exp(0.049a)+76.3)$ (Equation 3) is satisfied among the degree of processing a in the finish rolling step, I {200}/$I_0$ {200} after the finish rolling step and a temperature K (° C.) in the pre-annealing step (the pre-annealing time t must establish the equation: $t=38.0\times\exp(-0.004\ K)$, with the temperature K (° C.) in the pre-annealing step).

(Second Rolling Step)

Next, the second rolling is performed. The second rolling is also performed in the same manner as the general rolling method of the copper alloy, and the rolling rate would be preferably 70% or more.

(Solutionizing Step)

In the solutionizing treatment, heating is carried out at an elevated temperature of about 700 to about 980° C. for 10 seconds to 10 minutes to allow solid solution of a Co—Ni—Si based compound in the Cu matrix while at the same time recrystallizing the Cu matrix. In this step, the recrystallization and formation of the {200} crystal plane are carried out, but for solving the problem of the present invention, it is very important to control the crystal grain size in this step, as described above. The controlling of the crystal grain size is carried out by controlling the temperature and time of the solutionizing treatment, as described above. The crystal grain size varies depending on the cold rolling rate and the chemical composition before the solutionizing treatment. However, one of ordinary skill in the art will be able to readily set the retention time and attainment temperature within a temperature range of 700 to 980° C. based on previously experimentally determined relationship between the heat pattern of the solutionizing treatment and the crystal grain size for the alloy having each composition.

More particularly, the strength and the conductivity can be effectively increased by carrying out the cooling from about 400° C. to room temperature at a cooling rate of about 10° C. or higher per a second, and preferably about 15° C. or higher per a second, and more preferably about 20° C. or higher per a second or more. However, if the cooling rate is too high, any sufficient effect of increasing the strength may not be obtained. Therefore, the cooling rate may be preferably about 30° C. or lower per a second, and more preferably about 25° C. or lower per a second. The cooling rate can be adjusted by any method known to one of ordinary skill in the art. Generally, a decreased amount of water per unit time may cause a decreased cooling rate. Therefore, for example, the increase in the cooling rate can be achieved by increasing the number of the water cooling nozzle or increasing the amount of water per unit time. The "cooling rate" as used herein refers to a value (° C./s) calculated from the equation: "(solutionizing temperature−400) (° C.)/cooling time (s)", based on the measured cooling time from the solutionizing temperature (700° C. to 980° C.) to 400° C.

(Aging Treatment Step)

The aging treatment may be carried out in the same manner as the general copper alloy producing method. For example, the aging treatment may be carried out by heating the Ni—Co—Si compound solutionized in the solutionalizing step in a temperature range of from about 350 to about 600° C. for about 1 to 20 hours to deposit the solutionized compound as a fine particle. The aging treatment can increase the strength and the conductivity.

(Finish Rolling Step)

A cold rolling may be performed after aging in order to obtain higher strength after aging. In this case, the cold rolling step must be carried out under such conditions that the rolling rate for the finish rolling is 10% or more and 40% or less, and furthermore the relationship (Equation 3): $K=4.5\times(I\{200\}/I_0\{200\}\times\exp(0.049a)+76.3)$ is satisfied among the degree of processing a in the finish rolling step, $I\{200\}/I_0\{200\}$ after the finish rolling step and a temperature K (° C.) in the pre-annealing step, as described above. The final plate thickness may be preferably about 0.05 to 1.0 mm, and more preferably 0.08 to 0.5 mm.

(Low Temperature Annealing Step)

When the cold rolling is carried out after aging, stress relief annealing (low temperature annealing) may be optionally carried out after the cold rolling. This can reduce the residual stress in the copper alloy sheet material and improve the spring limit value and the stress relaxation resistance with little decrease in strength. The heating temperature is preferably set to be 150 to 550° C. If the heating temperature is too high, softening will occurs in a short time so that variation in properties will tend to occur. On the other hand, if the heating temperature is too low, sufficient effect of improving the above properties cannot be obtained. The heating time may be preferably at least 5 seconds, and good results will be usually obtained within one hour.

In addition, one of ordinary skill in the art would understand that any step such as grinding for removing oxided scales on the surface, polishing and shot-blast pickling may be carried out in the intervals of the respective steps, as needed.

EXAMPLES

Hereinafter, although Examples of the copper alloy sheet material and the method for producing the same according to the present invention will be described in detail, these Examples are intended to provide better understanding of the present invention and its advantages, and in no way intended to limit the present invention.

The copper alloys having various component compositions as shown in Tables 1 and 2 were melted at 1100° C. or higher using a high frequency melting furnace according to the flow as shown in FIG. 1, and cast into ingots each having a thickness of 25 mm. Each ingot was then heated at 400 to 950° C., and then hot-rolled to a thickness of 10 mm, and immediately cooled. The surface cutting was performed for each ingot to a thickness of 9 mm in order to removing scales on the surface, and the faced ingot was then cold-rolled to a plate thickness of 1.8 mm. The cold-rolled ingot was then subjected to the pre-annealing at 350 to 500° C. for about 8.5 hours, followed by the cold rolling and the subsequent solutionizing treatment at 700 to 980° C. for 5 to 3600 seconds, which was then immediately cooled to 100° C. or lower at the cooling rate of about 10° C./s. The ingot was then subjected to the cold rolling to 0.15 mm, and finally subjected to the aging treatment in an inert atmosphere at 350 to 600° C. over 1 to 24 hours depending on the added amount of each element of the copper alloy sheet materials, and a sample was produced by the finish cold rolling. The producing conditions for each copper alloy sheet material are shown in Tables 3 and 4.

Figure 4:
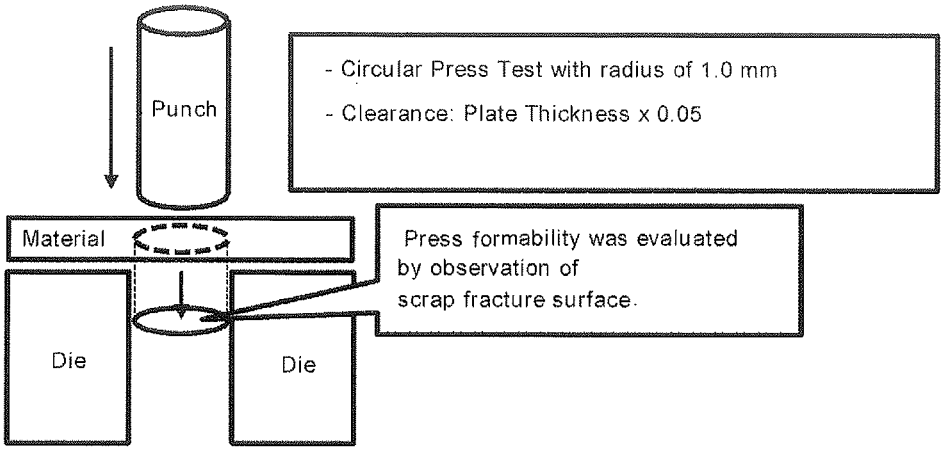
FIG. 4 is a schematic view for explaining a press test method.
Figure 5:
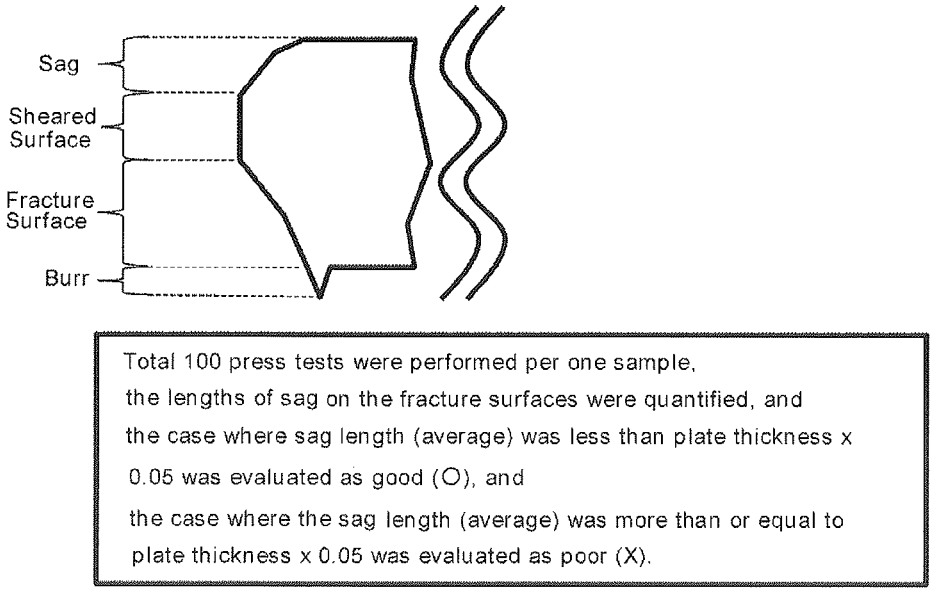
FIG. 5 is a schematic view for explaining an evaluation method of a fracture surface after pressing.

For each sheet material thus obtained, characterizations of the strength and the conductivity were carried out. For the strength, the 0.2% yield strength (YS) in a direction parallel to the rolling direction was measured using a tensile tester according to the standard JIS Z 2241. For the conductivity, each specimen was taken such that the longitudinal direction of the specimen was parallel to the rolling direction, and the conductivity of the specimen was determined by volume resistivity measurement using a double bridge method according to the standard JIS H 0505. For the bending formability, the 180° bending in directions parallel to the rolling direction (GW) and perpendicular to the rolling direction (BW) was evaluated according to the standard JIS Z 2248. The sheet material with R/t=0 was evaluated as good (○), and the sheet material with R/t>0 was evaluated as poor (x). For the press formability, 100 press tests in total were carried out by punching the sheet material into a circle shape having a radius of 1.0 mm by means of dies and a punch, as shown in FIG. 4, and the sag length of the scrap fracture surface was then quantified by the method as shown in FIG. 5, and the case where an average of 100 sag lengths was less than the plate thickness×0.05 was evaluated as good (○) and the case where the average was more than or equal to the plate thickness×0.05 was evaluated as poor (x).

For the integrated intensity ratio, the integrated intensity: $I\{200\}$ at the {200} diffraction peak was evaluated by X-ray diffraction in the thickness direction of the copper alloy sheet surface, and the integrated intensity: $I_0\{200\}$ at the {200} diffraction peak was further evaluated by X-ray diffraction of the fine powder copper, using HINT 2500 available from Rigaku Corporation. Subsequently, the ratio of these: $I\{200\}/I_0\{200\}$ was calculated. For the grain size, an average grain size was determined as GS (μm) by a cutting method of the standard JIS H 0501 in a direction parallel to the rolling direction of the specimen.

The plating adhesion for each copper alloy sheet material was evaluated by carrying out the following method defined in the standard JIS H 8504. More particularly, the specimen having a width of 10 mm was bended at 90° and then returned to the original angle (bending radius of 0.4 mm, in the direction parallel to the rolling direction (GW)), and the bended portion was then observed using an optical microscope (magnification 10×) to determine the presence or absence of peeling of the plated layer. The case where no peeling of the plated layer was observed was evaluated as good (○), and the case where the peeling of the plated layer was observed was evaluated as poor (x). The respective characterization results are shown in Table 5 and Table 6.

TABLE 1

| | Alloy Composition | | | | |
|---|---|---|---|---|---|
| | Ni | Co | Si | Cr | Other Elements |
| Example 1 | 1.30 | 1.30 | 0.60 | 0.20 | — |
| Example 2 | 1.30 | 1.30 | 0.60 | 0.20 | — |
| Example 3 | 1.30 | 1.30 | 0.60 | 0.20 | — |

TABLE 1-continued

| | Alloy Composition | | | | |
|---|---|---|---|---|---|
| | Ni | Co | Si | Cr | Other Elements |
| Example 4 | 1.30 | 1.30 | 0.60 | 0.20 | — |
| Example 5 | 1.30 | 1.30 | 0.60 | 0.20 | — |
| Example 6 | 1.30 | 1.30 | 0.60 | 0.20 | — |
| Example 7 | 1.30 | 1.30 | 0.60 | 0.20 | — |
| Example 8 | 1.30 | 1.30 | 0.60 | 0.20 | — |
| Example 9 | 1.30 | 1.30 | 0.60 | 0.20 | — |
| Example 10 | 1.30 | 1.30 | 0.60 | 0.20 | — |
| Example 11 | 1.30 | 1.30 | 0.60 | 0.20 | — |
| Example 12 | 1.30 | 1.30 | 0.60 | 0.20 | — |
| Example 13 | 1.30 | 1.30 | 0.60 | 0.20 | — |
| Example 14 | 0.55 | 1.30 | 0.60 | 0.20 | — |
| Example 15 | 2.45 | 1.30 | 0.60 | 0.20 | — |
| Example 16 | 1.30 | 0.52 | 0.60 | 0.20 | — |
| Example 17 | 1.30 | 2.48 | 0.60 | 0.20 | — |
| Example 18 | 1.30 | 1.30 | 0.32 | 0.20 | — |
| Example 19 | 1.30 | 1.30 | 1.18 | 0.20 | — |
| Example 20 | 1.30 | 1.30 | 0.60 | 0.00 | — |
| Example 21 | 1.30 | 1.30 | 0.60 | 0.11 | — |
| Example 22 | 1.30 | 1.30 | 0.60 | 0.48 | — |
| Example 23 | 1.30 | 1.30 | 0.60 | 0.20 | 0.1 Mg |
| Example 24 | 1.30 | 1.30 | 0.60 | 0.20 | 0.48 Mg |
| Example 25 | 1.30 | 1,30 | 0.60 | 0.20 | 0.1 Sn |
| Example 26 | 1.30 | 1.30 | 0.60 | 0.20 | 0.46 Sn |
| Example 27 | 1.30 | 1.30 | 0.60 | 0.20 | 0.1 Zn |
| Example 28 | 1.30 | 1.30 | 0.60 | 0.20 | 0.48 Zn |
| Example 29 | 1.30 | 1.30 | 0.60 | 0.20 | 0.1 Ag |
| Example 30 | 1.30 | 1.30 | 0.60 | 0.20 | 0.47 Ag |
| Example 31 | 1.30 | 1.30 | 0.60 | 0.20 | 0.1 Ti |
| Example 32 | 1.30 | 1.30 | 0.60 | 0.20 | 0.49 Ti |
| Example 33 | 1.30 | 1.30 | 0.60 | 0.20 | 0.1 Fe |
| Example 34 | 1.30 | 1.30 | 0.60 | 0.20 | 0.49 Fe |

TABLE 2

| | Alloy Composition | | | | |
|---|---|---|---|---|---|
| | Ni | Co | Si | Cr | Other Elements |
| Comparative Example 1 | 1.30 | 1.30 | 0.60 | 0.20 | — |
| Comparative Example 2 | 1.30 | 1.30 | 0.60 | 0.20 | — |
| Comparative Example 3 | 1.30 | 1.30 | 0.60 | 0.20 | — |
| Comparative Example 4 | 1.30 | 1.30 | 0.60 | 0.20 | — |
| Comparative Example 5 | 1.30 | 1.30 | 0.60 | 0.20 | — |
| Comparative Example 6 | 1.30 | 1.30 | 0.60 | 0.20 | — |
| Comparative Example 7 | 1.30 | 1.30 | 0.60 | 0.20 | — |
| Comparative Example 8 | 1.30 | 1.30 | 0.60 | 0.20 | — |

TABLE 2-continued

| | Alloy Composition | | | | |
|---|---|---|---|---|---|
| | Ni | Co | Si | Cr | Other Elements |
| Comparative Example 9 | 1.30 | 1.30 | 0.60 | 0.20 | — |
| Comparative Example 10 | 1.30 | 1.30 | 0.60 | 0.20 | — |
| Comparative Example 11 | 1.30 | 1.30 | 0.60 | 0.20 | — |
| Comparative Example 12 | 1.30 | 1.30 | 0.60 | 0.20 | — |
| Comparative Example 13 | 1.30 | 1.30 | 0.60 | 0.20 | — |
| Comparative Example 14 | 1.30 | 1.30 | 0.60 | 0.20 | — |
| Comparative Example 15 | 1.30 | 1.30 | 0.60 | 0.20 | — |
| Comparative Example 16 | 1.30 | 1.30 | 0.60 | 0.20 | — |
| Comparative Example 17 | 1.30 | 1.30 | 0.60 | 0.20 | — |
| Comparative Example 18 | 1.30 | 1.30 | 0.60 | 0.20 | — |
| Comparative Example 19 | 1.30 | 1.30 | 0.60 | 0.20 | — |
| Comparative Example 20 | 1.30 | 1.30 | 0.60 | 0.20 | — |
| Comparative Example 21 | 1.30 | 1.30 | 0.60 | 0.20 | — |
| Comparative Example 22 | 1.30 | 1.30 | 0.60 | 0.20 | — |
| Comparative Example 23 | 0.40 | 1.30 | 0.60 | 0.20 | — |
| Comparative Example 24 | 2.60 | 1.30 | 0.60 | 0.20 | — |
| Comparative Example 25 | 1.30 | 0.47 | 0.60 | 0.20 | — |
| Comparative Example 26 | 1.30 | 2.62 | 0.60 | 0.20 | — |
| Comparative Example 27 | 1.30 | 1.30 | 0.28 | 0.20 | — |
| Comparative Example 28 | 1.30 | 1.30 | 1.22 | 0.20 | — |
| Comparative Example 29 | 1.30 | 1.30 | 0.60 | 0.52 | — |
| Comparative Example 30 | 1.30 | 1.30 | 0.60 | 0.20 | 0.54Mg |
| Comparative Example 31 | 1.30 | 1.30 | 0.60 | 0.20 | 0.54Sn |
| Comparative Example 32 | 1,30 | 1.30 | 0.60 | 0.20 | 0.52Zn |
| Comparative Example 33 | 1.30 | 1.30 | 0.60 | 0.20 | 0.51Ag |
| Comparative Example 34 | 1.30 | 1.30 | 0.60 | 0.20 | 0.53Ti |
| Comparative Example 35 | 1.30 | 1.30 | 0.60 | 0.20 | 0.52Fe |
| Comparative Example 36 | | | | | |

TABLE 3

| | Producing Conditions | | | | | | |
|---|---|---|---|---|---|---|---|
| | Degree of Processing of First Rolling | Pre-annealing Conditions | | Degree of Processing of Second Rolling | Solutionizing Conditions | Aging Treatment Conditions | | Degree of Processing of Finish Rolling |
| | (%) | (° C.) | (h) | (%) | (° C. 20 s) | (° C.) | (h) | (%) |
| Example 1 | 40 | 365.4 | 8.8 | 70 | 980 | 396.3 | 8.0 | 10 |
| Example 2 | 30 | 376.9 | 8.4 | 70 | 870 | 368.2 | 8.0 | 20 |
| Example 3 | 40 | 387.8 | 8.1 | 80 | 814 | 505.4 | 8.0 | 25 |
| Example 4 | 30 | 400.1 | 7.7 | 80 | 783 | 433.3 | 8.0 | 30 |

TABLE 3-continued

| | Producing Conditions | | | | | | | |
|---|---|---|---|---|---|---|---|---|
| | Degree of Processing of First Rolling | Pre-annealing Conditions | | Degree of Processing of Second Rolling | Solutionizing Conditions | Aging Treatment Conditions | | Degree of Processing of Finish Rolling |
| | (%) | (° C.) | (h) | (%) | (° C. 20 s) | (° C.) | (h) | (%) |
| Example 5 | 30 | 432.8 | 6.7 | 90 | 760 | 564.5 | 8.0 | 40 |
| Example 6 | 30 | 350.7 | 9.3 | 80 | 802 | 362.5 | 6.0 | 10 |
| Example 7 | 40 | 360.2 | 9.0 | 80 | 726 | 381.2 | 6.0 | 25 |
| Example 8 | 40 | 378.5 | 8.4 | 80 | 702 | 404.8 | 6.0 | 40 |
| Example 9 | 30 | 357.3 | 9.1 | 80 | 899 | 368.2 | 8.0 | 10 |
| Example 10 | 40 | 370.9 | 8.6 | 80 | 765 | 359.4 | 8.0 | 25 |
| Example 11 | 30 | 404.0 | 7.5 | 80 | 730 | 370.6 | 8.0 | 40 |
| Example 12 | 40 | 419.7 | 7.1 | 80 | 860 | 423.3 | 8.0 | 30 |
| Example 13 | 30 | 499.9 | 5.1 | 80 | 825 | 479.2 | 8.0 | 40 |
| Example 14 | 30 | 399.1 | 7.7 | 80 | 782 | 436.7 | 8.0 | 30 |
| Example 15 | 30 | 398.2 | 7.7 | 80 | 775 | 437.7 | 8.0 | 30 |
| Example 16 | 30 | 398.8 | 7.7 | 80 | 783 | 432.9 | 8.0 | 30 |
| Example 17 | 30 | 398.8 | 7.7 | 80 | 778 | 436.5 | 8.0 | 30 |
| Example 18 | 30 | 399.2 | 7.7 | 80 | 783 | 430.9 | 8.0 | 30 |
| Example 19 | 30 | 398.6 | 7.7 | 80 | 778 | 436.2 | 8.0 | 30 |
| Example 20 | 30 | 398.6 | 7.7 | 80 | 780 | 430.6 | 8.0 | 30 |
| Example 21 | 30 | 402.1 | 7.6 | 80 | 781 | 433.2 | 8.0 | 30 |
| Example 22 | 30 | 400.1 | 7.7 | 80 | 781 | 436.5 | 8.0 | 30 |
| Example 23 | 30 | 398.8 | 7.7 | 80 | 776 | 430.6 | 8.0 | 30 |
| Example 24 | 30 | 398.3 | 7.7 | 80 | 779 | 430.8 | 8.0 | 30 |
| Example 25 | 30 | 399.1 | 7.7 | 80 | 780 | 434.5 | 8.0 | 30 |
| Example 26 | 30 | 399.8 | 7.7 | 80 | 778 | 437.8 | 8.0 | 30 |
| Example 27 | 30 | 398.4 | 7.7 | 80 | 776 | 430.5 | 8.0 | 30 |
| Example 28 | 30 | 398.8 | 7.7 | 80 | 773 | 435.8 | 8.0 | 30 |
| Example 29 | 30 | 399.7 | 7.7 | 80 | 779 | 437.2 | 8.0 | 30 |
| Example 30 | 30 | 399.3 | 7.7 | 80 | 773 | 431.8 | 8.0 | 30 |
| Example 31 | 30 | 398.2 | 7.7 | 80 | 782 | 438.7 | 8.0 | 30 |
| Example 32 | 30 | 399.4 | 7.7 | 80 | 777 | 437.2 | 8.0 | 30 |
| Example 33 | 30 | 398.6 | 7.7 | 80 | 778 | 438.4 | 8.0 | 30 |
| Example 34 | 30 | 399.5 | 7.7 | 80 | 776 | 433.2 | 8.0 | 30 |

TABLE 3

| | Producing Conditions | | | | | | | |
|---|---|---|---|---|---|---|---|---|
| | Degree of Processing of First Rolling | Pre-annealing Conditions | | Degree of Processing of Second Rolling | Solutionizing Conditions | Aging Treatment Conditions | | Degree of Processing of Finish Rolling |
| | (%) | (° C.) | (h) | (%) | (° C. 20 s) | (° C.) | (h) | (%) |
| Comparative Example 1 | 40 | 450.0 | 5.8 | 70 | 750.0 | 356.5 | 8 | 10 |
| Comparative Example 2 | 30 | 450.0 | 5.8 | 70 | 729.1 | 587.2 | 8 | 30 |
| Comparative Example 3 | 40 | 500.0 | 4.5 | 80 | 700.0 | 587.2 | 8 | 30 |
| Comparative Example 4 | 40 | 500.0 | 4.5 | 80 | 820.1 | 587.1 | 8 | 30 |
| Comparative Example 5 | 40 | 500.0 | 4.5 | 80 | 808.2 | 370.6 | 8 | 30 |
| Comparative Example 6 | 40 | 500.0 | 4.5 | 80 | 980.2 | 390.0 | 8 | 30 |
| Comparative Example 7 | 40 | 450.0 | 5.8 | 80 | 962.8 | 437.5 | 8 | 10 |
| Comparative Example 8 | 40 | 450.0 | 5.8 | 80 | 868.8 | 435.4 | 8 | 20 |
| Comparative Example 9 | 40 | 450.0 | 5.8 | 80 | 813.0 | 429.2 | 8 | 25 |
| Comparative Example 10 | 40 | 450.0 | 5.8 | 80 | 783.2 | 419.4 | 8 | 30 |
| Comparative Example 11 | 40 | 500.0 | 4.5 | 80 | 760.2 | 425.2 | 8 | 40 |
| Comparative Example 12 | 30 | 450.0 | 5.8 | 70 | 962.8 | 636.0 | 8 | 10 |
| Comparative Example 13 | 30 | 450.0 | 5.8 | 70 | 868.3 | 673.5 | 8 | 20 |

TABLE 3-continued

| | Producing Conditions | | | | | | | |
|---|---|---|---|---|---|---|---|---|
| | Degree of Processing of First Rolling | Pre-annealing Conditions | | Degree of Processing of Second Rolling | Solutionizing Conditions | Aging Treatment Conditions | | Degree of Processing of Finish Rolling |
| | (%) | (° C.) | (h) | (%) | (° C. 20 s) | (° C.) | (h) | (%) |
| Comparative Example 14 | 30 | 500.0 | 4.5 | 70 | 812.4 | 611.1 | 8 | 25 |
| Comparative Example 15 | 30 | 500.0 | 4.6 | 90 | 783.8 | 625.2 | 8 | 30 |
| Comparative Example 16 | 30 | 500.0 | 4.5 | 90 | 761.5 | 677.4 | 8 | 40 |
| Comparative Example 17 | 30 | 450.0 | 5.8 | 80 | 962.8 | 344.8 | 8 | 10 |
| Comparative Example 18 | 30 | 500.0 | 4.5 | 80 | 867.2 | 343.1 | 8 | 20 |
| Comparative Example 19 | 30 | 450.0 | 5.8 | 80 | 813.0 | 350.4 | 8 | 25 |
| Comparative Example 20 | 30 | 400.0 | 7.2 | 80 | 783.8 | 343.1 | 8 | 30 |
| Comparative Example 21 | 30 | 400.0 | 7.2 | 80 | 762.2 | 342.5 | 8 | 40 |
| Comparative Example 22 | 40 | 450.0 | 5.8 | 80 | 962.8 | 662.0 | 8 | 10 |
| Comparative Example 23 | 40 | 450.0 | 5.8 | 80 | 766.9 | 669.7 | 8 | 10 |
| Comparative Example 24 | 30 | 400.1 | 7.2 | 80 | 783.2 | 433.3 | 8 | 30 |
| Comparative Example 25 | 30 | 400.1 | 7.2 | 80 | 783.2 | 337.7 | 8 | 30 |
| Comparative Example 26 | 30 | 400.1 | 7.2 | 80 | 783.2 | 433.3 | 8 | 30 |
| Comparative Example 27 | 30 | 400.1 | 7.2 | 80 | 783.2 | 336.3 | 8 | 30 |
| Comparative Example 28 | 30 | 400.1 | 7.2 | 80 | 783.2 | 433.3 | 8 | 30 |
| Comparative Example 29 | 30 | 400.1 | 7.2 | 80 | 783.2 | 347.1 | 8 | 30 |
| Comparative Example 30 | 30 | 400.1 | 7.2 | 80 | 783.2 | 433.3 | 8 | 30 |
| Comparative Example 31 | 30 | 400.1 | 7.2 | 80 | 783.2 | 433.3 | 8 | 30 |
| Comparative Example 32 | 30 | 400.1 | 7.2 | 80 | 783.2 | 433.3 | 8 | 30 |
| Comparative Example 33 | 30 | 400.1 | 7.2 | 80 | 783.2 | 433.3 | 8 | 30 |
| Comparative Example 34 | 30 | 400.1 | 7.2 | 80 | 783.2 | 433.3 | 8 | 30 |
| Comparative Example 35 | 30 | 400.1 | 7.2 | 80 | 783.2 | 433.3 | 8 | 30 |
| Comparative Example 36 | 30 | 400.1 | 7.2 | 80 | 783.2 | 433.3 | 8 | 30 |

TABLE 5

| | | | | Properties | | | | | |
|---|---|---|---|---|---|---|---|---|---|
| | | | | | | Bending Formability (R/t) | | | |
| | Grain Size (um) | $I\{200\}/I_0\{200\}$ | $\frac{I\{200\}/I_0\{200\}}{\text{Grain Size}} \times 100$ | Conductivity (% IACS) | 0.2% Yield Strength (MPa) | Good Way | Bad Way | Press Formability | Plating Adhesion and Hot Rolling Formability |
| Example 1 | 60.0 | 3.0 | 5.0 | 47.0 | 822 | ○ | ○ | ○ | ○ |
| Example 2 | 32.0 | 2.8 | 8.8 | 45.0 | 805 | ○ | ○ | ○ | ○ |
| Example 3 | 22.0 | 2.9 | 13.2 | 52.0 | 760 | ○ | ○ | ○ | ○ |
| Example 4 | 17.0 | 2.9 | 17.1 | 49.0 | 800 | ○ | ○ | ○ | ○ |
| Example 5 | 13.4 | 2.8 | 20.9 | 54.0 | 723 | ○ | ○ | ○ | ○ |
| Example 6 | 20.0 | 1.0 | 5.0 | 44.5 | 805 | ○ | ○ | ○ | ○ |
| Example 7 | 8.6 | 1.1 | 12.8 | 46.0 | 810 | ○ | ○ | ○ | ○ |
| Example 8 | 5.3 | 1.1 | 20.8 | 47.5 | 822 | ○ | ○ | ○ | ○ |
| Example 9 | 38.0 | 1.9 | 5.0 | 45.0 | 800 | ○ | ○ | ○ | ○ |
| Example 10 | 14.2 | 1.8 | 12.7 | 44.2 | 830 | ○ | ○ | ○ | ○ |

TABLE 5-continued

| | Properties | | | | | | | | |
|---|---|---|---|---|---|---|---|---|---|
| | | | | | | Bending Formability (R/t) | | | |
| | Grain Size (um) | I{200}/I$_0$\{200\} | $\frac{I\{200\}/I_0\{200\}}{\text{Grain Size}} \times 100$ | Conductivity (% IACS) | 0.2% Yield Strength (MPa) | Good Way | Bad Way | Press Formability | Plating Adhesion and Hot Rolling Formability |
| Example 11 | 9.1 | 1.9 | 20.9 | 45.2 | 890 | ○ | ○ | ○ | ○ |
| Example 12 | 30.2 | 3.9 | 12.9 | 48.5 | 870 | ○ | ○ | ○ | ○ |
| Example 13 | 23.8 | 4.9 | 20.6 | 51.0 | 820 | ○ | ○ | ○ | ○ |
| Example 14 | 17.1 | 2.8 | 16.7 | 49.3 | 796 | ○ | ○ | ○ | ○ |
| Example 15 | 17.3 | 2.8 | 16.2 | 49.4 | 800 | ○ | ○ | ○ | ○ |
| Example 16 | 17.3 | 2.8 | 16.4 | 49.1 | 796 | ○ | ○ | ○ | ○ |
| Example 17 | 17.0 | 2.8 | 16.6 | 48.5 | 796 | ○ | ○ | ○ | ○ |
| Example 18 | 16.6 | 2.9 | 17.0 | 49.0 | 798 | ○ | ○ | ○ | ○ |
| Example 19 | 16.7 | 2.8 | 16.9 | 49.2 | 804 | ○ | ○ | ○ | ○ |
| Example 20 | 17.0 | 2.8 | 16.6 | 44.0 | 805 | ○ | ○ | ○ | ○ |
| Example 21 | 17.4 | 3.0 | 17.2 | 51.5 | 798 | ○ | ○ | ○ | ○ |
| Example 22 | 17.4 | 2.9 | 16.5 | 52.1 | 802 | ○ | ○ | ○ | ○ |
| Example 23 | 16.9 | 2.8 | 16.8 | 49.3 | 802 | ○ | ○ | ○ | ◎ |
| Example 24 | 17.2 | 2.8 | 16.4 | 49.0 | 800 | ○ | ○ | ○ | ◎ |
| Example 25 | 16.8 | 2.8 | 17.0 | 48.6 | 800 | ○ | ○ | ○ | ◎ |
| Example 26 | 17.4 | 2.9 | 16.5 | 48.8 | 798 | ○ | ○ | ○ | ◎ |
| Example 27 | 16.9 | 2.8 | 16.7 | 49.5 | 800 | ○ | ○ | ○ | ◎ |
| Example 28 | 17.1 | 2.8 | 16.6 | 48.8 | 799 | ○ | ○ | ○ | ◎ |
| Example 29 | 17.3 | 2.9 | 16.7 | 48.6 | 803 | ○ | ○ | ○ | ◎ |
| Example 30 | 17.4 | 2.9 | 16.5 | 49.1 | 798 | ○ | ○ | ○ | ◎ |
| Example 31 | 16.7 | 2.8 | 16.8 | 49.1 | 800 | ○ | ○ | ○ | ◎ |
| Example 32 | 16.8 | 2.9 | 17.0 | 49.2 | 803 | ○ | ○ | ○ | ◎ |
| Example 33 | 17.0 | 2.8 | 16.6 | 49.0 | 798 | ○ | ○ | ○ | ◎ |
| Example 34 | 16.5 | 2.9 | 17.4 | 48.6 | 800 | ○ | ○ | ○ | ◎ |

TABLE 6

| | Properties | | | | | | | | |
|---|---|---|---|---|---|---|---|---|---|
| | | | | | | Bending Formability (R/t) | | | |
| | Grain Size (um) | I{200}/I$_0$\{200\} | $\frac{I\{200\}/I_0\{200\}}{\text{Grain Size}} \times 100$ | Conductivity (% IACS) | 0.2% Yield Strength (MPa) | Good Way | Bad Way | Press Formability | Plating Adhesion and Hot Rooling Formability |
| Comparative Example 1 | 12.0 | 3.3 | 27.5 | 43.9 | 740 | ○ | ○ | x | ○ |
| Comparative Example 2 | 9.0 | 3.7 | 41.1 | 54.7 | 820 | ○ | ○ | x | ○ |
| Comparative Example 3 | 5.0 | 1.1 | 22.0 | 54.7 | 802 | ○ | ○ | x | ○ |
| Comparative Example 4 | 23.0 | 5.0 | 21.7 | 48.2 | 815 | ○ | ○ | x | ○ |
| Comparative Example 5 | 21.0 | 1.0 | 4.8 | 45.2 | 805 | ○ | ○ | x | ○ |
| Comparative Example 6 | 60.0 | 2.8 | 4.7 | 46.5 | 820 | ○ | ○ | x | ○ |
| Comparative Example 7 | 54.2 | 2.8 | 5.2 | 49.2 | 903 | ○ | ○ | x | ○ |
| Comparative Example 8 | 31.8 | 2.9 | 9.1 | 49.1 | 901 | ○ | ○ | x | ○ |
| Comparative Example 9 | 21.8 | 2.8 | 12.8 | 48.8 | 902 | ○ | ○ | x | ○ |
| Comparative Example 10 | 17.0 | 2.8 | 16.5 | 48.3 | 905 | ○ | ○ | x | ○ |
| Comparative Example 11 | 13.5 | 2.8 | 20.7 | 48.6 | 910 | ○ | ○ | x | ○ |
| Comparative Example 12 | 54.2 | 2.8 | 5.2 | 56.1 | 713 | ○ | ○ | x | ○ |
| Comparative Example 13 | 31.7 | 2.9 | 9.1 | 57.1 | 715 | ○ | ○ | x | ○ |
| Comparative Example 14 | 21.7 | 2.8 | 12.9 | 55.4 | 719 | ○ | ○ | x | ○ |
| Comparative Example 15 | 17.1 | 2.8 | 16.4 | 55.8 | 714 | ○ | ○ | x | ○ |
| Comparative Example 16 | 13.7 | 2.8 | 20.4 | 57.2 | 711 | ○ | ○ | x | ○ |
| Comparative Example 17 | 54.2 | 2.8 | 5.2 | 42.4 | 723 | ○ | ○ | x | ○ |

TABLE 6-continued

| | Properties | | | | | | | | |
|---|---|---|---|---|---|---|---|---|---|
| | | | | | | Bending Formability (R/t) | | | |
| | Grain Size (um) | I{200}/I$_0$\{200\} | $\frac{I\{200\}/I_0\{200\}}{\text{Grain Size}} \times 100$ | Conductivity (% IACS) | 0.2% Yield Strength (MPa) | Good Way | Bad Way | Press Formability | Plating Adhesion and Hot Rooling Formability |
| Comparative Example 18 | 31.5 | 2.9 | 9.2 | 42.1 | 745 | ○ | ○ | x | ○ |
| Comparative Example 19 | 21.8 | 2.8 | 12.8 | 43.2 | 753 | ○ | ○ | x | ○ |
| Comparative Example 20 | 17.1 | 2.8 | 16.4 | 42.1 | 820 | ○ | ○ | x | ○ |
| Comparative Example 21 | 13.8 | 2.9 | 21.0 | 42.0 | 856 | ○ | ○ | x | ○ |
| Comparative Example 22 | 54.2 | 3.0 | 5.5 | 56.8 | 718 | ○ | ○ | x | ○ |
| Comparative Example 23 | 14.5 | 3.0 | 20.7 | 57 | 715 | ○ | ○ | x | ○ |
| Comparative Example 24 | 17.0 | 2.9 | 17.1 | 49.0 | 710 | ○ | ○ | x | ○ |
| Comparative Example 25 | 17.0 | 2.9 | 17.1 | 38.5 | 800 | ○ | ○ | x | x |
| Comparative Example 26 | 17.0 | 2.9 | 17.1 | 49.0 | 705 | ○ | ○ | x | ○ |
| Comparative Example 27 | 17.0 | 2.9 | 17.1 | 39.5 | 800 | ○ | ○ | x | x |
| Comparative Example 28 | 17.0 | 2.9 | 17.1 | 49.0 | 695 | ○ | ○ | x | ○ |
| Comparative Example 29 | 17.0 | 2.9 | 17.1 | 36.5 | 842 | ○ | ○ | x | x |
| Comparative Example 30 | 17.0 | 2.9 | 17.1 | 49.0 | 800 | ○ | ○ | x | x |
| Comparative Example 31 | 17.0 | 2.9 | 17.1 | 40.0 | 800 | ○ | ○ | x | ○ |
| Comparative Example 32 | 17.0 | 2.9 | 17.1 | 40.0 | 800 | ○ | ○ | x | ○ |
| Comparative Example 33 | 17.0 | 2.9 | 17.1 | 49.0 | 800 | ○ | ○ | x | ○ |
| Comparative Example 34 | 17.0 | 2.9 | 17.1 | 49.0 | 800 | ○ | ○ | x | ○ |
| Comparative Example 35 | 17.0 | 2.9 | 17.1 | 49.0 | 800 | ○ | ○ | x | ○ |
| Comparative Example 36 | 17.0 | 2.9 | 17.1 | 40.0 | 800 | ○ | ○ | x | ○ |

All of Examples 1 to 34 could provide the copper alloy materials that achieved all the high strength, the high conductivity and improved bending formability, and had improved press formability. However, Comparative Examples 1 to 6 in which the value of {(I {200}/I$_0$ {200})/GS}×100 was beyond the range of 5 to 21 did not provide the optimum producing conditions for the pre-annealing and the finish rolling and did not satisfy the predetermined relationship (Equation 3) between the temperature in the pre-annealing step and the finish rolling, so that the balance between the I {200}/I$_0$ {200} of the final product and the grain size was poor, and the press formability was poor as compared with Examples 1 to 34.

Comparative Examples 7 to 11 in which the value of {(I {200}/I$_0$ {200})/GS}×100 was within the range of 5 to 21 but the 0.2% yield strength exceeded 900 MPa provided higher spring back during the press working because of the high strength, and also provided poor press formability as compared with Examples 1 to 34.

Comparative Examples 12 to 16 in which the value of {(I {200}/I$_0$ {200})/GS}×100 was within the range of 5 to 21 but the conductivity was higher than 55% IACS and the 0.2% yield strength was below 720 MPa provided higher ductility because of lower strength and also extremely larger sag or burr during the press working, so that the press formability was poor as compared with Examples 1 to 34.

Comparative Examples 17 to 21 in which the value of {(I {200}/I$_0$ {200})/GS}×100 was within the range of 5-21 but the conductivity was below 43.5% IACS provided poor press formability as compared with Examples 1 to 34, due to ununiform deposition of the Ni—Si based intermetallic compound particles.

Comparative Example 22 and 23 in which the value of {(I {200}/I$_0$ {200})/GS}×100 was within the range of 5 to 21 but the conductivity exceeded 55% IACS and the 0.2% yield strength was below 720 MPa provided poor press formability as compared with Examples 1 to 34, for the same reasons as described above.

Comparative Examples 24 to 30 illustrates the case where the amounts of the main elements Ni, Co, Si, Cr and the like added are beyond the predetermined range. It can be seen that each strength or conductivity is very poor as compared with Examples 1 to 34. Further, Comparative Examples 24 to 30 also provided poor press formability for the reasons that have already been stated.

Comparative Examples 31 to 36 illustrates the case where the amounts of Mg, Sn, Zn, Ag, Ti and Fe that can be added in the present invention exceed 0.5% by mass. Comparison of these Comparative Examples with Examples 23 to 34 that added appropriate amounts demonstrates that the plating adhesion and hot rolling formability are not effectively improved. Further, the press formability in each comparative example was also poor because coarse inclusions derived from these added elements would extremely wear the mold during the press working.

What is claimed is:

1. A copper alloy sheet material comprising 0.5 to 2.5% by mass of Ni, 0.5 to 2.5% by mass of Co, 0.30 to 1.2% by mass of Si and 0.0 to 0.5% by mass of Cr, the balance being Cu and unavoidable impurities, wherein the copper alloy sheet material fulfills the relationships $1.0 \leq I\{200\}/I_0\{200\} \leq 5.0$ and $5.0\ \mu m \leq GS \leq 60.0\ \mu m$, and these have the relationship (Equation 1): $5.0 \leq \{(I\{200\}/I_0\{200\})/GS\} \times 100 \leq 21.0$, in which the I {200} represents an X-ray diffraction intensity of a {200} crystal plane on the plate surface, the $I_0$ {200} represents an X-ray diffraction intensity of a {200} crystal plane of standard pure copper powder, and the GS (μm) represents an average crystal grain size as determined by a cutting method of JIS H 0501, wherein the copper alloy sheet material has an electrical conductivity of 43.5% IACS or more and 55.0% IACS or less, and 0.2% yield strength of 720 MPa or more and 900 MPa or less, wherein according to a press formability test, an average of 100 sag lengths is less than plate thickness×0.05, wherein the press formability test includes 100 press tests of punching sheet material into a circle shape having a radius of 1.0 mm.

2. The copper alloy sheet material according to claim 1, further comprising a total of up to 0.5% by mass of one or more elements selected from the group consisting of Mg, Sn, Ti, Fe, Zn and Ag.

3. A method for producing a copper alloy sheet material according to claim 1, comprising the successive steps of:

melting and casting a raw material of a copper alloy comprising 0.5 to 2.5% by mass of Ni, 0.5 to 2.5% by mass of Co, 0.30 to 1.2% by mass of Si, and 0.0 to 0.5% by mass of Cr, the balance being Cu and unavoidable impurities;

hot-rolling the material while lowering the temperature from 950° C. to 400° C.;

cold-rolling the material at a rolling rate of 30% or more;

pre-annealing the material by carrying out a heat treatment for the purpose of deposition, at a heating temperature of 350 to 500° C. for 5.0 to 9.5 hours (calculation formula (Equation 2): $t=38.0\times\exp(-0.004\ K)$ is satisfied between the time of the pre-annealing step (t) and a temperature K (° C.);

cold-rolling the material at a rolling rate of 70% or more;

solutionizing the material at a heating temperature of 700 to 980° C.;

aging-treating the material at 350 to 600° C.; and finish-cold-rolling the material at a rolling rate of 10% or more and 40% or less, wherein the producing conditions are adjusted such that calculation formula (Equation 3): $K=4.5\times(I\{200\}/I_0\{200\}\times\exp(0.049a)+76.3)$ is satisfied among a degree of processing a in the finish cold rolling step, $I\{200\}/I_0\{200\}$ after the finish cold rolling step, and a temperature K (° C.) in the pre-annealing step.

4. The method for producing the copper alloy sheet material according to claim 3, wherein the copper apply sheet material further comprises a total of up to 0.5% by mass of one or more elements selected from the group consisting of Mg, Sn, Ti, Fe, Zn and Ag.

* * * * *